US006814264B2

(12) United States Patent
Chen

(10) Patent No.: US 6,814,264 B2
(45) Date of Patent: Nov. 9, 2004

(54) LIQUID PUMPING DEVICE

(76) Inventor: Chi-Liang Chen, 58, Ma Yuan West St., Taichung (TW)

( * ) Notice: Subject to any disclaimer, the term of this patent is extended or adjusted under 35 U.S.C. 154(b) by 121 days.

(21) Appl. No.: 10/370,323

(22) Filed: Feb. 13, 2003

(65) Prior Publication Data

US 2004/0159682 A1 Aug. 19, 2004

(51) Int. Cl.[7] ..... B65D 83/00
(52) U.S. Cl. ..... 222/402; 222/482
(58) Field of Search ..... 222/373, 383.1, 222/384, 385, 401, 402, 478, 482

(56) References Cited

U.S. PATENT DOCUMENTS 655,954 A * 8/1900 Brooks ..... 222/396
2,031,172 A * 2/1936 Maloney ..... 222/182
3,709,409 A * 1/1973 Collins ..... 222/402

* cited by examiner

*Primary Examiner*—Gene Mancene
*Assistant Examiner*—Patrick Buechner

(57) ABSTRACT

A liquid pumping device includes a base, a liquid container, a cover, a cylinder, a piston, an air guide pipe, and an operation handle. When the piston is moved upward, the fluid can only flow downward through the anti-reverse valves of the piston in a single direction, and the upward movement of the liquid is stopped by the anti-reverse valves of the piston. When the air guide pipe is moved downward, the fluid can only flow upward through the anti-reverse valves of the air guide pipe in a single direction, and the downward movement of the liquid is stopped by the anti-reverse valves of the air guide pipe.

18 Claims, 8 Drawing Sheets

LIQUID PUMPING DEVICE

BACKGROUND OF THE INVENTION

1. Field of the Invention

The present invention relates to a liquid pumping device, and more particularly to a liquid pumping device that can pump the fluid easily and conveniently.

2. Description of the Related Art

A conventional liquid pumping device in accordance with the prior art comprises a base, a liquid container, and a cylinder. However, the compression spring secured on the bottom of the inside of the cylinder easily produces an elastic fatigue during a long-term utilization, thereby affecting the air drainage effect of the oneway valve.

SUMMARY OF THE INVENTION

The present invention is to mitigate and/or obviate the disadvantage of the conventional liquid pumping device.

The primary objective of the present invention is to provide a liquid pumping device including a piston formed with a plurality of anti-reverse valves, wherein when the piston is moved upward, the fluid can only flow downward through the anti-reverse valves of the piston in a single direction, and the upward movement of the liquid is stopped by the anti-reverse valves of the piston.

Another objective of the present invention is to provide a liquid pumping device including an air guide pipe provided with an anti-reverse valves, wherein when the air guide pipe is moved downward, the fluid can only flow upward through the anti-reverse valves of the air guide pipe in a single direction, and the downward movement of the liquid is stopped by the anti-reverse valves of the air guide pipe.

In accordance with the present invention, there is provided a liquid pumping device, comprising a base, a liquid container, a cover, a cylinder, a piston, an air guide pipe, and an operation handle, wherein:

the liquid container has a lower end secured on the base;

the cover is secured on an upper end of the liquid container, the bottom face of the cover is formed with a protruding block, the protruding block of the cover has an inner wall having an upper portion formed with an annular insertion recess and a lower portion formed with an air guide channel, the inner wall of the protruding block of the cover is formed with a passage hole communicated between the insertion recess and the air guide channel, the bottom face of the cover is formed with an air guide hole communicated with an upper section of the air guide channel, the air guide hole has a mediate portion formed with a through hole extended through the bottom face of the cover and communicating with the liquid container;

the cylinder is secured on the cover and located in the liquid container;

the piston is slidably mounted in the cylinder and has a center formed with a passage hole, the piston has a periphery formed with a plurality of anti-reverse valves;

the air guide pipe is slidably mounted in the cylinder and has an inner wall formed with an air guide hole, the inner wall of the air guide pipe has a lower end provided with an anti-reverse valves; and the operation handle is secured on the upper end of the air guide pipe.

Further benefits and advantages of the present invention will become apparent after a careful reading of the detailed description with appropriate reference to the accompanying drawings.

DETAILED DESCRIPTION OF THE INVENTION

Figure 1:
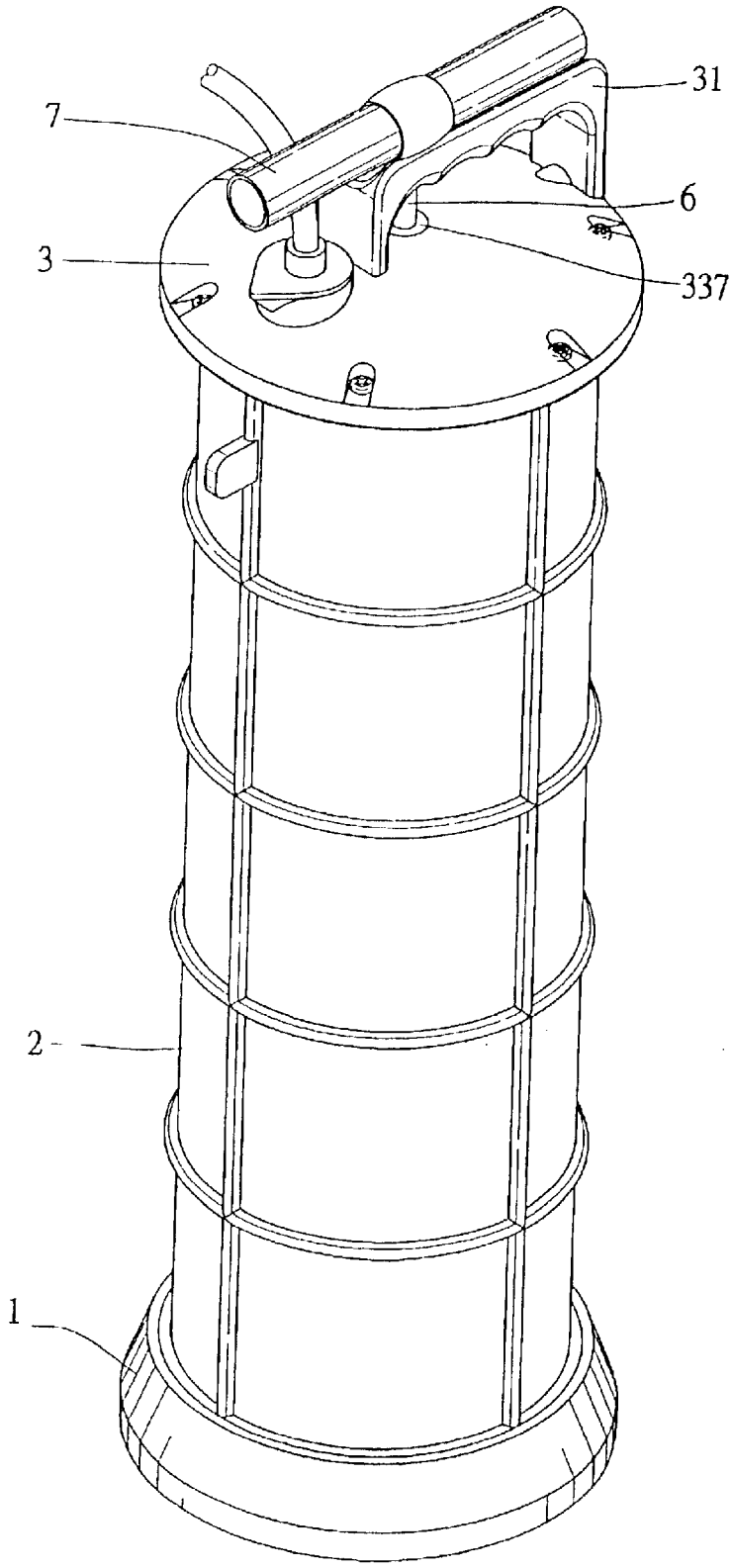
FIG. 1 is a perspective view of a liquid pumping device in accordance with the preferred embodiment of the present invention.
Figure 2:
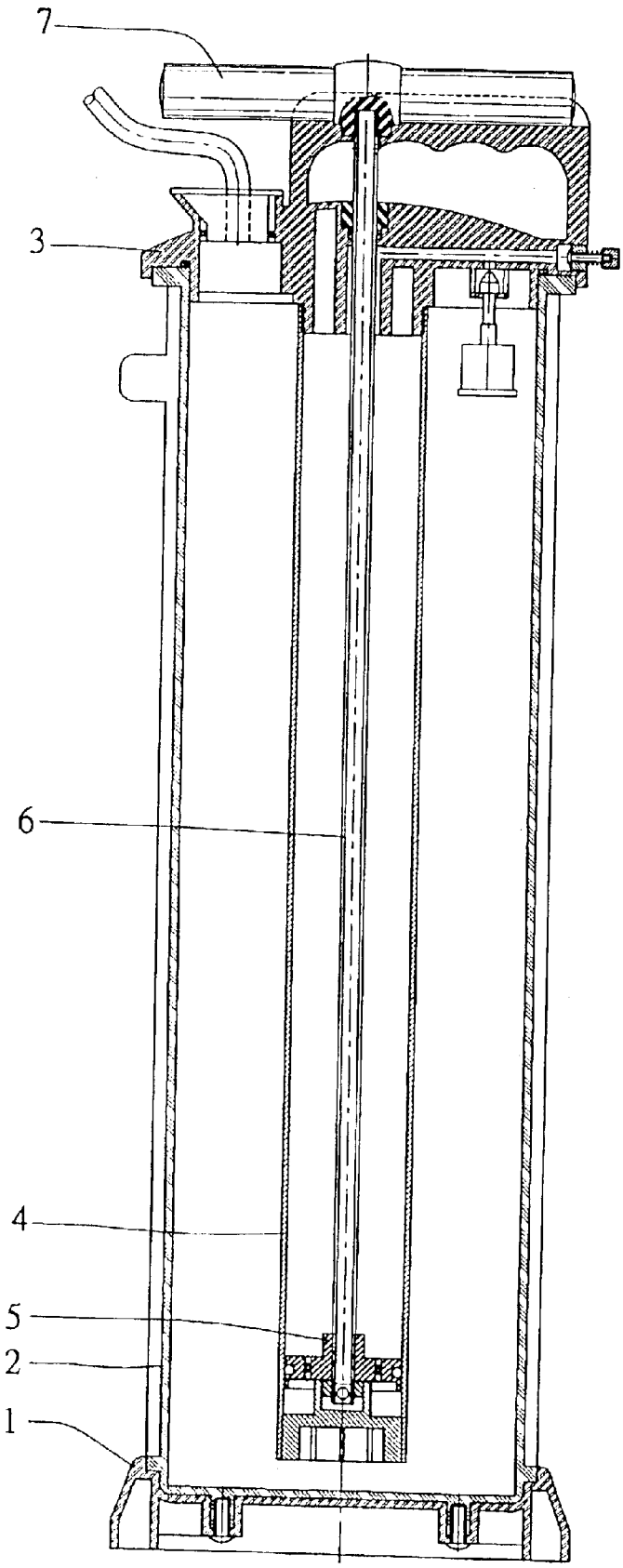
FIG. 2 is a side plan cross-sectional view of the liquid pumping device as shown in FIG. 1.
Figure 3:
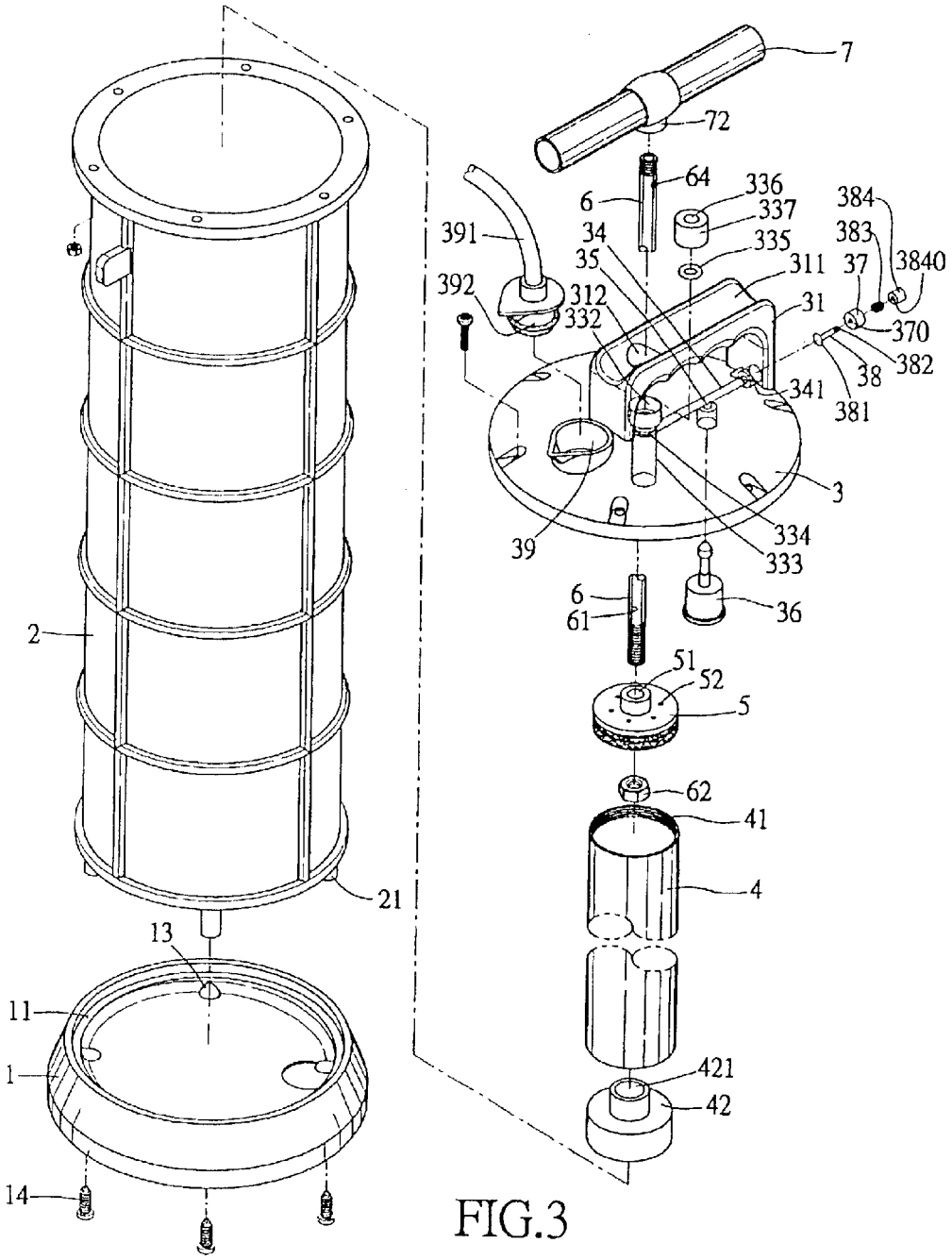
FIG. 3 is an exploded perspective view of the liquid pumping device in accordance with the preferred embodiment of the present invention.
Figure 4:
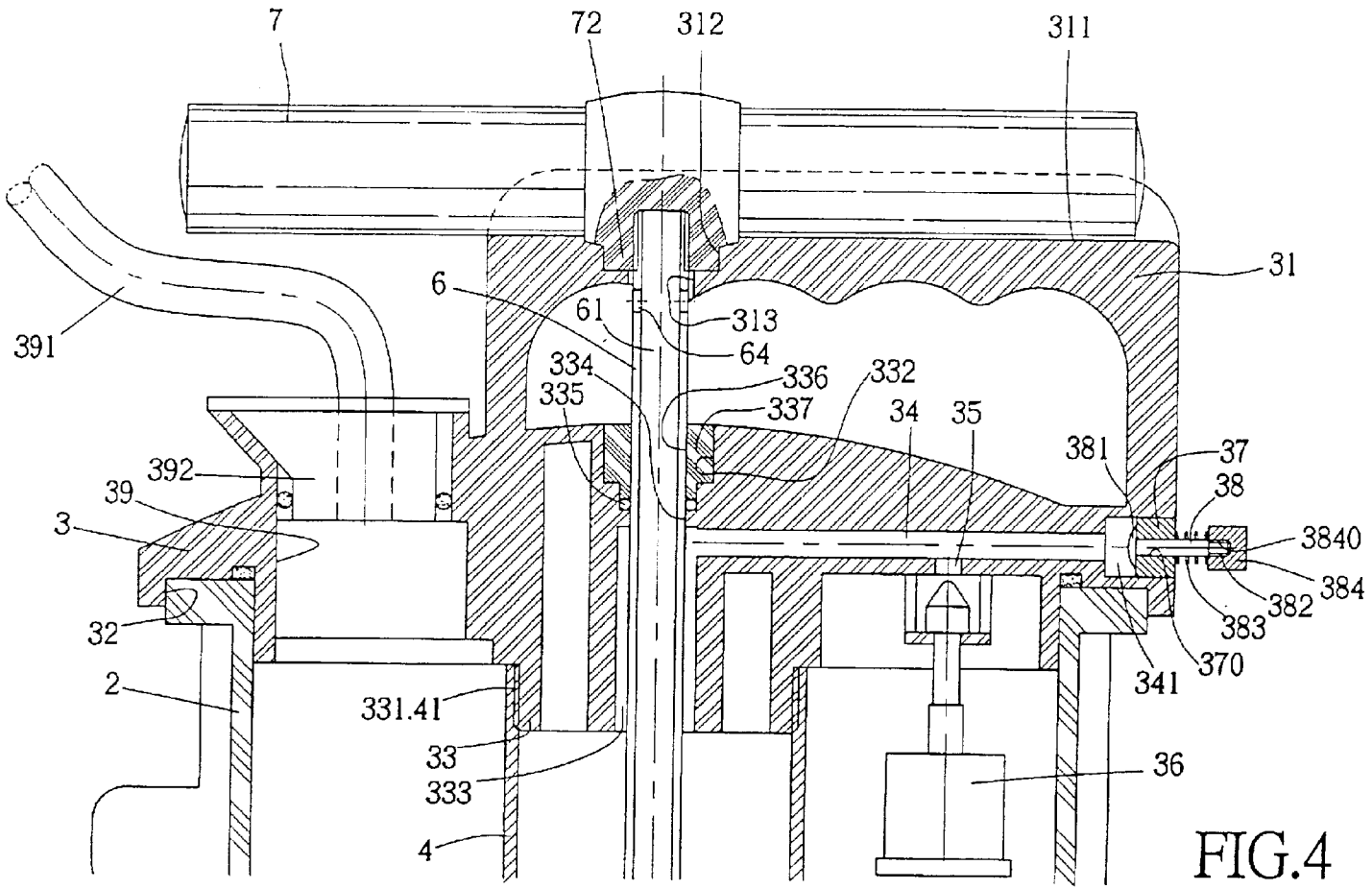
FIG. 4 is a partially cut-away enlarged view of the liquid pumping device as shown in FIG. 2.
Figure 5:
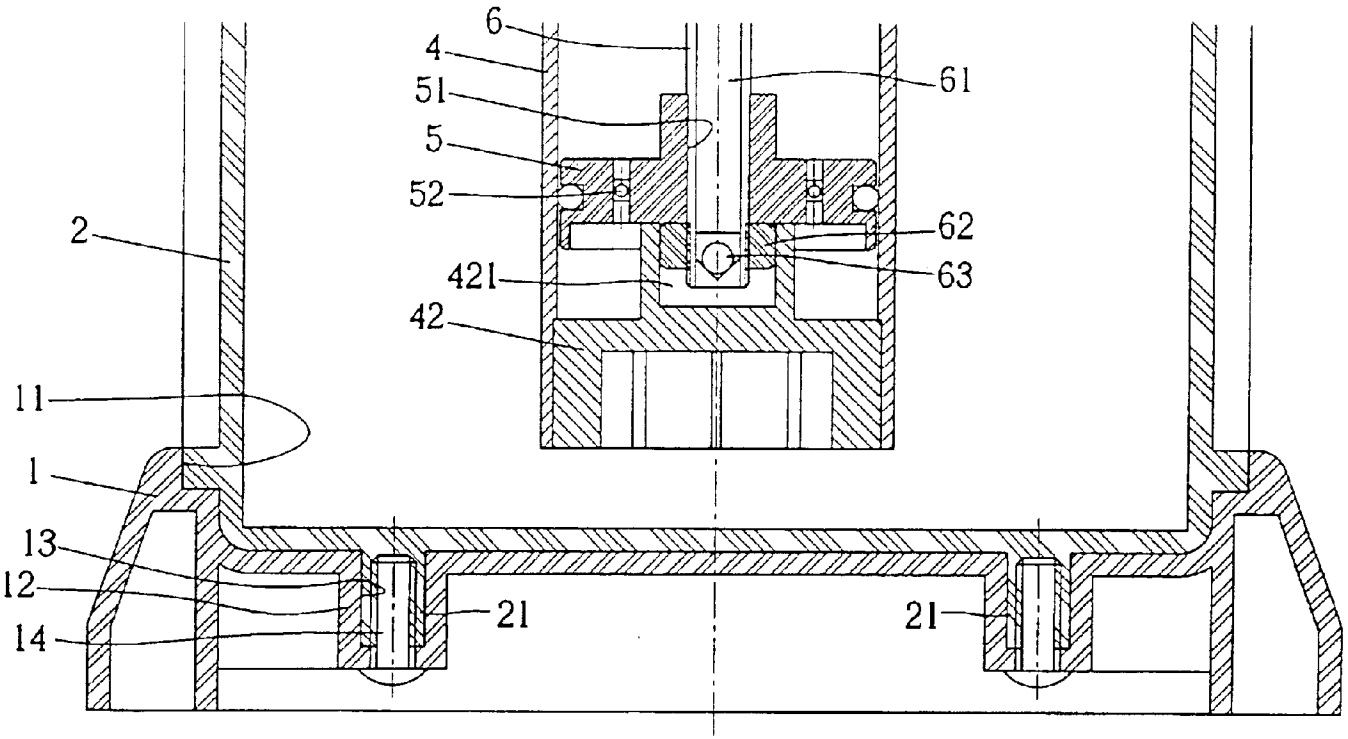
FIG. 5 is a partially cut-away enlarged view of the liquid pumping device as shown in FIG. 2.

Referring to the drawings and initially to FIGS. 1-5, a liquid pumping device in accordance with the preferred embodiment of the present invention comprises a base 1, a liquid container 2, a cover 3, a cylinder 4, a piston 5, an air guide pipe 6, and an operation handle 7.

The base 1 has an upper end formed with an annular insertion groove 11. The insertion groove 11 of the base 1 has a bottom face formed with a plurality of lugs 12 each extending downward therefrom. Each of the lugs 12 is formed with a counterbore 13.

The liquid container 2 has a lower end secured on the base 1. The lower end of the liquid container 2 is received in the insertion groove 11 of the base 1. The lower end of the liquid container 2 has a bottom face formed with a plurality of threaded columns 21 each inserted into the counterbore 13 of a respective one of the lugs 12. The liquid pumping device further comprises a plurality of screw members 14 each extended through the counterbore 13 of a respective one of the lugs 12 and each screwed into a respective one of the threaded columns 21, thereby securing the lower end of the liquid container 2 on the base 1.

The cover 3 is secured on an upper end of the liquid container 2. The cover 3 has a top formed with an inverted U-shaped grip 31. The cover 3 has a bottom face formed with an annular insertion groove 32 for receiving the upper end of the liquid container 2. The bottom face of the cover 3 is formed with a protruding block 33 which is formed with an outer thread 331. The protruding block 33 of the cover 3 has an inner wall having an upper portion formed with an annular insertion recess 332 and a lower portion formed with an air guide channel 333. The inner wall of the protruding block 33 of the cover 3 is formed with a passage hole 334 communicated between the insertion recess 332 and the air guide channel 333.

The liquid pumping device further comprises an O-ring 335 mounted in the insertion recess 332 of the cover 3, and a press block 337 mounted in the insertion recess 332 of the cover 3 and urged on the O-ring 335. The press block 337 is formed with a through hole 336.

The bottom face of the cover 3 is formed with an air guide hole 34 communicated with an upper section of the air guide channel 333. The air guide hole 34 is arranged vertical to the air guide channel 333. The air guide hole 34 has a mediate portion formed with a through hole 35 extended through the bottom face of the cover 3 and communicating with the liquid container 2. The through hole 35 of the air guide hole 34 is arranged vertical to the air guide hole 34. The liquid pumping device further comprises a float 36 suspended on the bottom face of the cover 3 and engageable with the through hole 35 of the cover 3.

The air guide hole 34 has a distal end formed with an annular insertion recess 341. The liquid pumping device further comprises a fixing ring 37 mounted in the insertion recess 341 of the air guide hole 34, an operation rod 38 slidably mounted in the fixing ring 37 and having a first end formed with an enlarged seal ring 381 located in the insertion recess 341 of the air guide hole 34 and rested on the fixing ring 37, an adjusting knob 384 secured on a second end of the operation rod 38, and an elastic member 383 mounted on the operation rod 38 and urged between the fixing ring 37 and the adjusting knob 384. The fixing ring 37 is formed with a through hole 370 communicating with the air guide hole 34. The second end of the operation rod 38 is formed with an outer thread 382, and the adjusting knob 384 is formed with an inner thread 3840 screwed on the outer thread 382 of the operation rod 38.

The grip 31 of the cover 3 has a top face formed with an arcuate concave portion 311. In addition, the arcuate concave portion 311 of the grip 31 has a wall formed with an annular insertion recess 312 aligning with the insertion recess 332 of the protruding block 33. The insertion recess 312 of the grip 31 has a lower portion formed with a passage hole 313 aligning with the passage hole 334 of the protruding block 33.

The cover 3 has a side formed with a liquid access port 39. The liquid pumping device further comprises a liquid guide pipe 391 having a distal end inserted into the liquid access port 39 of the cover 3, and a seal ring 392 mounted on the liquid guide pipe 391 and urged on the liquid access port 39 of the cover 3.

The cylinder 4 is secured on the cover 3 and located in the liquid container 2. The cylinder 4 has an inner wall having an upper end formed with an inner thread 41 screwed on the outer thread 331 of the protruding block 33 of the cover 3. The liquid pumping device further comprises a sealing disk 42 secured on a lower end of the inner wall of the cylinder 4 and having a top face formed with a chamber 421.

The piston 5 is slidably mounted in the cylinder 4 and has a center formed with a passage hole 51. The piston 5 has a periphery formed with a plurality of anti-reverse valves 52, wherein the liquid can only flow downward through the anti-reverse valves 52 of the piston 5, and the upward movement of the liquid is stopped by the anti-reverse valves 52 of the piston 5.

The air guide pipe 6 is slidably mounted in the cylinder 4 and has an inner wall formed with an air guide hole 61. The air guide pipe 6 has a lower end extended through the passage hole 51 of the piston 5 and screwed with a nut 62 which is rested on the bottom of the piston 5. The inner wall of the air guide pipe 6 has a lower end provided with an anti-reverse valves 63, wherein the liquid can only flow upward through the anti-reverse valves 63 of the air guide pipe 6, and the downward movement of the liquid is stopped by the anti-reverse valves 63 of the air guide pipe 6. The air guide pipe 6 has an upper end extended through the passage hole 334 of the protruding block 33 and the passage hole 313 of the grip 31. The air guide pipe 6 has a top formed with an air outlet 64 communicating with the air guide hole 61.

The operation handle 7 is secured on the upper end of the air guide pipe 6, and is mounted in the arcuate concave portion 311 of the grip 31 of the cover 3. The operation handle 7 has a bottom provided with a plug 72 that can be inserted into the insertion recess 312 of the grip 31.

Figure 6:
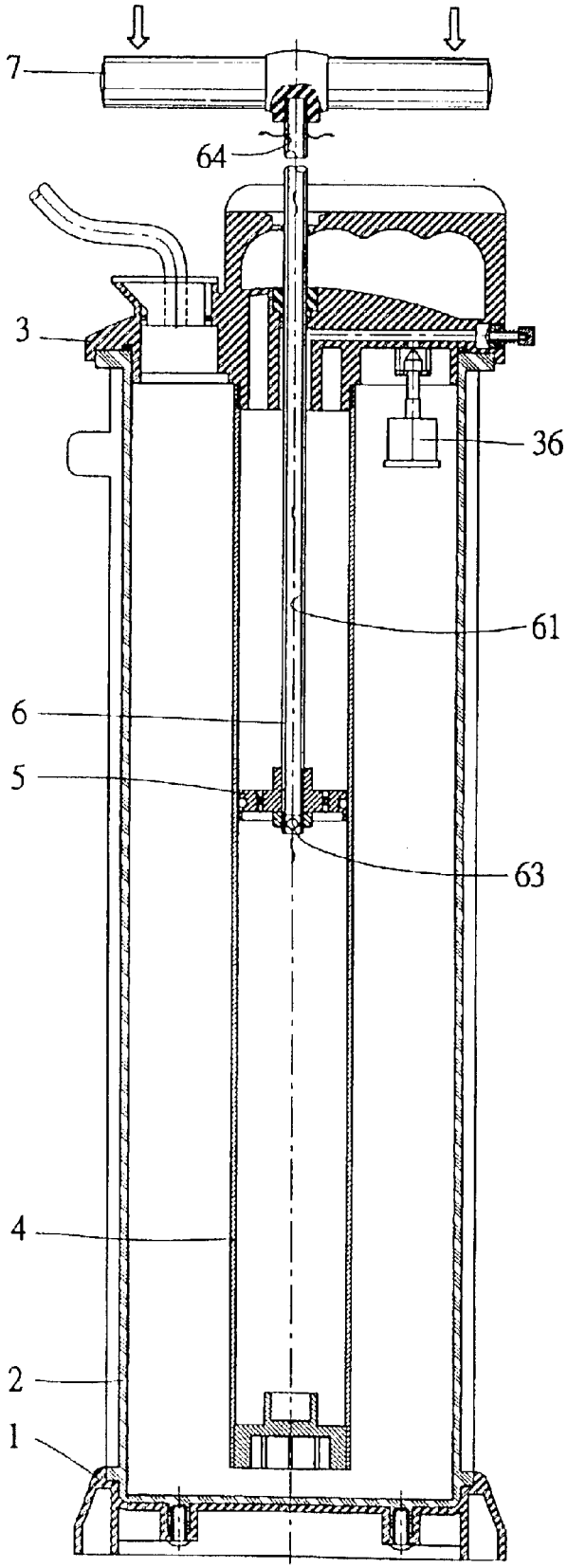
FIG. 6 is a schematic operational view of the liquid pumping device as shown in FIG. 2 in use.
Figure 7:
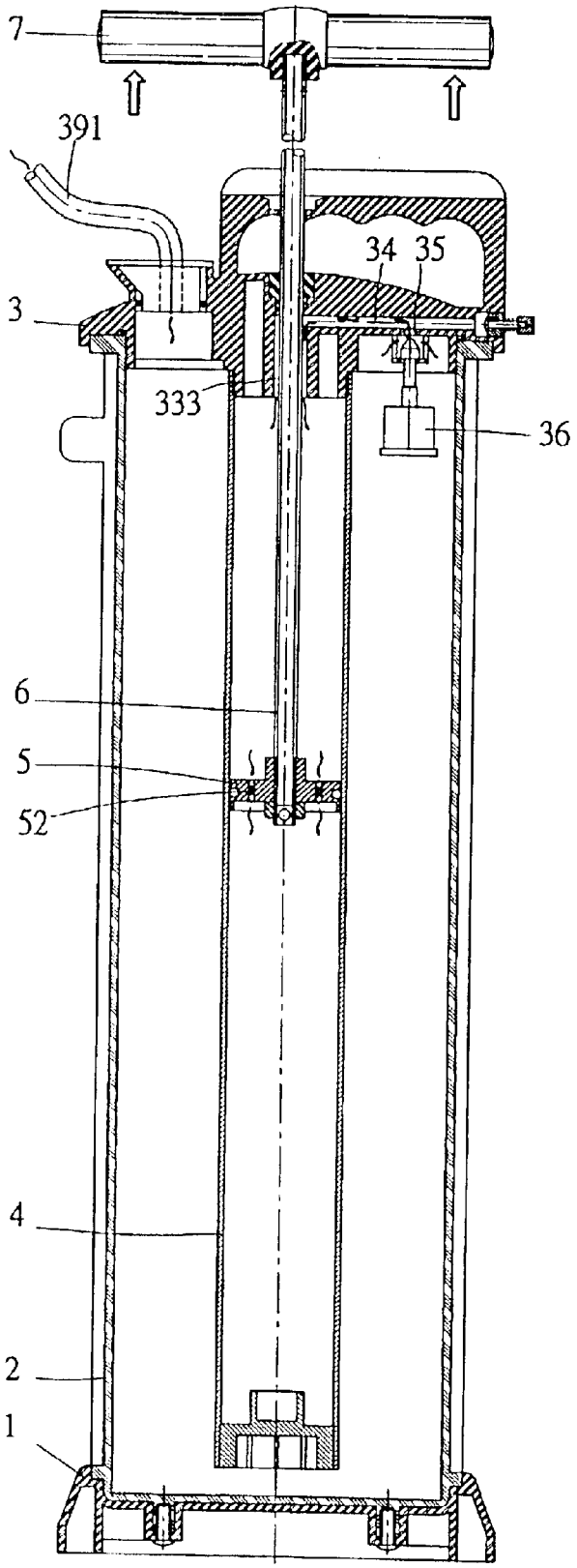
FIG. 7 is a schematic operational view of the liquid pumping device as shown in FIG. 6 in use.
Figure 8:
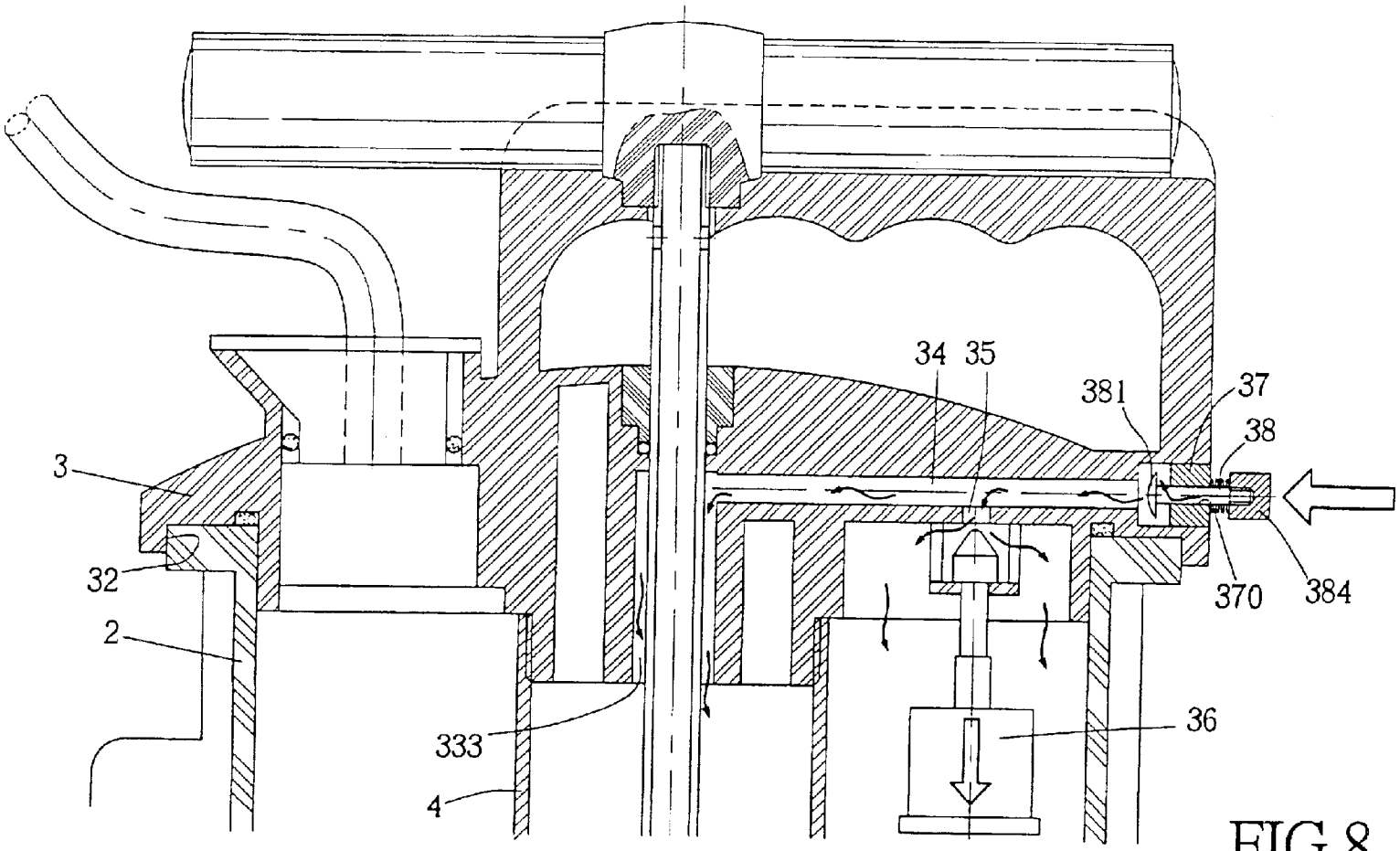
FIG. 8 is a schematic operational view of the liquid pumping device as shown in FIG. 4.

In operation, referring to FIGS. 6-8 with reference to FIGS. 1-5, when the operation handle 7 is pressed downward as shown in FIG. 6, the air guide pipe 6 is moved downward to move the piston 5 downward to compress the air contained in the cylinder 4 located under the piston 5, thereby producing an upward pressure in the cylinder 4. In such a manner, the air contained in the cylinder 4 located under the piston 5 can flow upward through the anti-reverse valves 63 of the air guide pipe 6 in a single direction and flow into the air guide hole 61 of the air guide pipe 6, and can then be drained outward through the air outlet 64 of the air guide pipe 6.

Alternatively, when the operation handle 7 is pressed downward as shown in FIG. 7, the air guide pipe 6 is moved upward to move the piston 5 upward to compress the air contained in the cylinder 4 located above the piston 5, thereby producing a downward pressure in the cylinder 4. In such a manner, the air contained in the cylinder 4 located above the piston 5 can flow downward through the anti-reverse valves 52 of the piston 5 in a single direction and can flow into the lower space of the cylinder 4 located under the piston 5, so that the upper space of the cylinder 4 located above the piston 5 forms a negative pressure, thereby forcing the air contained in the liquid container 2 to flow through the through hole 35, the air guide hole 34 and the air guide channel 333 of the cover 3 into the upper space of the cylinder 4 located above the piston 5. Thus, the inside of the liquid container 2 forms a negative pressure, thereby forcing the liquid to flow through the liquid guide pipe 391 into the liquid container 2.

When the liquid to flowing into the liquid container 2 reaches the full level of the float 36, the float 36 is lifted to seal the through hole 35 of the cover 3, thereby stopping filling the liquid. At this time, the space between the air guide hole 34 and the air guide channel 333 of the cover 3 and the upper space of the cylinder 4 located above the piston 5 forms a vacuum state, thereby sealing the through hole 35 of the cover 3.

As shown in FIG. 8, the adjusting knob 384 is pressed inward to move the operation rod 38 inward to detach the seal ring 381 from the fixing ring 37, thereby communicating the through hole 370 of the fixing ring 37 with the air guide hole 34, so that the ambient air can flow through the through hole 370 of the fixing ring 37, the air guide hole 34, the through hole 35 and the air guide channel 333 of the cover 3, to push the float 36, thereby detaching the float 36 from the through hole 35 of the cover 3, so as to release the vacuum state of the space between the air guide hole 34 and the air guide channel 333 of the cover 3 and the upper space of the cylinder 4 located above the piston 5, so that the liquid contained in the liquid container 2 can be poured outward through the liquid access port 39 of the cover 3 conveniently.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A liquid pumping device, comprising a base, a liquid container, a cover, a cylinder, a piston, an air guide pipe, and an operation handle, wherein:

the liquid container has a lower end secured on the base;

the cover is secured on an upper end of the liquid container, the bottom face of the cover is formed with a protruding block, the protruding block of the cover has an inner wall having an upper portion formed with an annular insertion recess and a lower portion formed with an air guide channel, the inner wall of the protruding block of the cover is formed with a passage hole communicated between the insertion recess and the air guide channel, the bottom face of the cover is formed with an air guide hole communicated with an upper section of the air guide channel, the air guide hole has a mediate portion formed with a through hole extended through the bottom face of the cover and communicating with the liquid container;

the cylinder is secured on the cover and located in the liquid container;

the piston is slidably mounted in the cylinder and has a center formed with a passage hole, the piston has a periphery formed with a plurality of anti-reverse valves;

the air guide pipe is slidably mounted in the cylinder and has an inner wall formed with an air guide hole, the inner wall of the air guide pipe has a lower end provided with an anti-reverse valves; and the operation handle is secured on the upper end of the air guide pipe.

2. The liquid pumping device in accordance with claim 1, wherein the base has an upper end formed with an annular insertion groove, and the lower end of the liquid container is received in the insertion groove of the base.

3. The liquid pumping device in accordance with claim 1, wherein the insertion groove of the base has a bottom face formed with a plurality of lugs each formed with a counterbore, the lower end of the liquid container has a bottom face formed with a plurality of threaded columns each inserted into the counterbore of a respective one of the lugs, and the liquid pumping device further comprises a plurality of screw members each extended through the counterbore of a respective one of the lugs and each screwed into a respective one of the threaded columns, thereby securing the lower end of the liquid container on the base.

4. The liquid pumping device in accordance with claim 1, wherein the cover has a top formed with an inverted U-shaped grip having a top face formed with an arcuate concave portion, the arcuate concave portion of the grip has a wall formed with an annular insertion recess aligning with the insertion recess of the protruding block, the insertion recess of the grip has a lower portion formed with a passage hole aligning with the passage hole of the protruding block.

5. The liquid pumping device in accordance with claim 1, wherein the cover has a bottom face formed with an annular insertion groove for receiving the upper end of the liquid container.

6. The liquid pumping device in accordance with claim 1, wherein the protruding block which is formed with an outer thread, and the cylinder has an inner wall having an upper end formed with an inner thread screwed on the outer thread of the protruding block of the cover.

7. The liquid pumping device in accordance with claim 1, further comprising an O-ring mounted in the insertion recess of the cover, and a press block mounted in the insertion recess of the cover and urged on the O-ring, and the press block is formed with a through hole.

8. The liquid pumping device in accordance with claim 7, wherein the air guide hole is arranged vertical to the air guide channel.

9. The liquid pumping device in accordance with claim 1, wherein the through hole of the air guide hole is arranged vertical to the air guide hole.

10. The liquid pumping device in accordance with claim 1, further comprising a float suspended on the bottom face of the cover and engageable with the through hole of the cover.

11. The liquid pumping device in accordance with claim 1, wherein the air guide hole has a distal end formed with an annular insertion recess, and the liquid pumping device further comprises a fixing ring mounted in the insertion recess of the air guide hole, an operation rod slidably mounted in the fixing ring and having a first end formed with an enlarged seal ring located in the insertion recess of the air guide hole and rested on the fixing ring, an adjusting knob secured on a second end of the operation rod, and an elastic member mounted on the operation rod and urged between the fixing ring and the adjusting knob.

12. The liquid pumping device in accordance with claim 11, wherein the fixing ring is formed with a through hole communicating with the air guide hole, the second end of the operation rod is formed with an outer thread, and the adjusting knob is formed with an inner thread screwed on the outer thread of the operation rod.

13. The liquid pumping device in accordance with claim 1, wherein the cover has a side formed with a liquid access port, and the liquid pumping device further comprises a liquid guide pipe having a distal end inserted into the liquid access port of the cover, and a seal ring mounted on the liquid guide pipe and urged on the liquid access port of the cover.

14. The liquid pumping device in accordance with claim 1, further comprising a sealing disk secured on a lower end of the inner wall of the cylinder and having a top face formed with a chamber.

15. The liquid pumping device in accordance with claim 1, wherein the air guide pipe has a lower end extended through the passage hole of the piston and screwed with a nut which is rested on the bottom of the piston.

16. The liquid pumping device in accordance with claim 4, wherein the air guide pipe has an upper end extended through the passage hole of the protruding block and the passage hole of the grip.

17. The liquid pumping device in accordance with claim 4, wherein the operation handle is mounted in the arcuate concave portion of the grip of the cover.

18. The liquid pumping device in accordance with claim 4, wherein the operation handle has a bottom provided with a plug inserted into the insertion recess of the grip.

* * * * *